US005590477A

United States Patent [19]

Carfagno, Sr.

[11] Patent Number: 5,590,477

[45] Date of Patent: Jan. 7, 1997

[54] DRYER VENT BOX AND METHOD

[76] Inventor: Michael B. Carfagno, Sr., Rte. 1, Box 63, Wesley, Ark. 72773

[21] Appl. No.: 466,376

[22] Filed: Jun. 6, 1995

[51] Int. Cl.[6] ..... F26B 19/00

[52] U.S. Cl. ..... 34/235; 285/424; 454/339

[58] Field of Search ..... 34/235; 285/64, 285/424; 454/339, 359, 337, 341

[56] References Cited

U.S. PATENT DOCUMENTS

| | | | |
|---|---|---|---|
| D. 218,825 | 9/1970 | Blumer | 23/40 |
| D. 335,174 | 4/1993 | Anderson et al. | D23/393 |
| 3,123,939 | 12/1961 | Erickson | 285/64 |
| 3,466,063 | 9/1969 | Traver | 285/183 |
| 3,847,175 | 11/1974 | Anderson | 137/360 |
| 3,892,049 | 7/1975 | Adams, Jr. | 34/235 |
| 5,121,948 | 6/1992 | Anderson et al. | 285/168 |

OTHER PUBLICATIONS

Handi–Plumb Brochure, 1994, p. 25.
Improvements, Fall–Winter 1994 Catalog, p. 66.

*Primary Examiner*—Henry A. Bennett
*Assistant Examiner*—Dinnatia Doster
*Attorney, Agent, or Firm*—Daniel R. Alexander; Head, Johnson & Kachigian

[57] ABSTRACT

A dryer vent box and method is provided which addresses the problems inherent in conventional dryer vent assemblies. The dryer vent box includes upper and lower mating substantially rectangular housings which are dimensioned to be received within the confines of a conventional 2×4 studded wall. Each of the upper and lower rectangular housings have a protruding cylindrical flange with an opening into the housing to provide for the intake and exhaust of dryer exhaust gasses. The upper housing section includes at least one tab extending from one of the sides thereof to provide for the attachment of the upper housing to the wall. The lower housing includes cutoff markings or indicators which provide for the correct placement of the cylindrical flange of the upper housing relative to the dryer outlet. Thus, the dryer vent box of the present invention provides an aesthetically pleasing, effective, efficient and improved dryer venting assembly. An outside or exterior vent box includes rectangular upper and lower housings with cylindrical flanges extending from opposite faces of the assembled item. Additionally, a nozzle, flap, or displaceable louver is placed over the cylindrical flange extending from the upper housing. A rectangular housing having opposing cylindrical flanges is used as an exterior exhaust vent box.

18 Claims, 5 Drawing Sheets

DRYER VENT BOX AND METHOD

BACKGROUND OF THE INVENTION

Field of the Invention

The present invention is directed to air vents and ducts, methods of venting and directing air or exhaust, and construction methods and apparatus related thereto. The present invention more particularly concerns a clothes drier vent box and method for through-the-wall, ceiling and/or floor venting of clothes dryer exhaust from the interior of a home, apartment, building, and the like, an outside dryer vent box and method, and an outside or exterior exhaust box and method.

As shown in FIG. 1 of the drawings, conventional residential home construction, clothes dryer venting duct work includes a large diameter polyvinyl chloride (PVC) 90° elbow 10, a vertical section of large diameter PVC pipe 12, another 90° elbow 14, and an elongate section of large diameter PVC pipe 16 which extends from the elbow 14 to the exterior of the slab or foundation. The slab 18 is covered with plywood decking 20, and hardwood flooring 22. The dryer 24 is conventional and shown to be resting about six inches away from a conventional 2×4 studded wall 25 having drywall wallboard 28 and 30 attached to vertical 2×4 studs 26 in a conventional fashion. Drywall wallboard 28 includes a large circular opening 32 which accommodates one end of PVC elbow 10. Drywall wallboard 30 includes a slower protruding or broken portion 34 which extends beyond the normal dimension of the 2×4 studded wall 25 to accommodate the remainder of PVC elbow 10 and the upper end of PVC pipe or riser 12. Baseboards or trim 36 are added to the base of drywall wallboards 28 and 30 adjacent hardwood flooring 22. Clothes drier 24 includes an exhaust gas or air outlet pipe 38 which is operatively connected to the open end of elbow 10 by a flexible plastic or metal conduit 40. Typically, one end of the flexible conduit 40 is simply placed into the open end of elbow 10 while the other end is placed over the drier outlet 38 and held in position either by friction or a removable clip or clamp.

This conventional dryer venting arrangement (FIG. 1) suffers from several drawbacks. First, the wall 26 has to be partially modified, destroyed, or broken to accommodate the elbow 10 and upper end of pipe 12. Second, the large opening 32 in drywall section 28 and open end of elbow 10 are unsightly and usually misplaced with respect to the outlet 38 of dryer 24. Third, flexible conduit 40 provides for fluid communication between outlet 38 and elbow 10, but tends to buckle and bow and in so doing prevents the full flow of exhaust gas or air from dryer 24 to reach elbow 10. This blockage tends to reduce the efficiency of the dryer 24, increase energy consumption, and may cause dust collection within the conduit 40, and thereby further prevent the passage of exhaust air or gases therethrough. Fourth, the end of flexible conduit 40 may become dislodged from the opening in elbow 10 and require the dryer to be moved away from the wall and the conduit placed back into the elbow. Fifth, the broken or bowed out lower portion 34 of drywall wallboard 30 is unsightly and causes bowing in the baseboard 36. This protruding portion 34 of the wall may obstruct the placement of items up against drywall wallboard 30 and reduce the aesthetic quality as well as the usefulness of that portion of the wall and room.

Also, if one attempts to avoid the protrusion of the lower portion 34 of drywall 30 by moving the elbow 10 to the right, this causes the open end of the elbow 10 to extend through the drywall wallboard 28 which is not only unsightly, and detracts from the aesthetic quality of the wall, but also may cause the dryer to have to be moved further out into the room thereby reducing the remaining useful room space.

Similar undesirable venting assemblies are found in conventional multi-unit residential units as well as commercial and industrial buildings and plants. In some instances, a clothes dryer or similar device is vented to the outside of the building by simply knocking a large opening through the outer wall and placing a length of large diameter PVC pipe therein to serve as a vent. This produces unsightly openings in the interior and exterior of the wall, may not provide for proper placement or location of the vent opening relative to the dryer outlet, and may leave a large outer opening which allows the entrance of rain, insects, rodents, etc.

Thus, there exists a need for an improved venting assembly and method for the venting of exhaust gases or air.

SUMMARY OF THE INVENTION

In accordance with the present invention, a dryer vent box and method is provided which addresses the problems inherent in conventional dryer vent assemblies. In accordance with an exemplary embodiment of the present invention, a dryer vent box includes upper and lower mating substantially rectangular housings which are dimensioned so as to be received within the confines of a conventional 2×4 studded wall. Each of the upper and lower rectangular housings have a protruding cylindrical flange with an opening into the housing to provide for the intake and exhaust of dryer exhaust gases or air. The upper housing section includes at least one tab or wing extending from one of the sides thereof to provide for the attachment of the upper housing to the wall. The lower housing includes cutoff markings or indicators which provide for the correct placement of the cylindrical flange of the upper housing relative to the dryer outlet. Thus, the dryer vent box of the present invention provides an aesthetically pleasing, effective, efficient and improved dryer venting assembly.

In accordance with a particular example of the present invention, the dryer vent box housings are molded PVC and the lower housing includes elongate notches which facilitate the sawing off of the lower housing by hacksaw or other device capable of cleanly sawing through PVC to provide for the adjustment of the upper housing relative to the dryer outlet. Further, the cylindrical flanges protruding from the upper and lower housings can be shortened by being sawed off or shortened with a hacksaw or other instrument, such as a pipe cutter, to the desired length to provide for the best fit of the vent box for its particular application. By having the dryer vent box housings molded of PVC, the dryer vent box of the present invention meets building code requirements which mandate that only certain materials including PVC may be located in the concrete slab or foundation.

The dryer vent box of the present invention provides the advantages of eliminating unsightly or crude conventional dryer vent wall openings, provides for the close placement of the dryer up against a wall so as to increase the useful room area and reduce or eliminate the happenstance dropping of clothing or other items behind the dryer. In at least some circumstances and if used properly, the present dryer vent box eliminates the need for a flexible conduit for providing fluid communication between the dryer outlet and the dryer vent box inlet. Also, the dryer vent box is adapted for use in through the wall, through the wall and floor, through the wall and ceiling, slab or peer and beam construction, stacked washer and dryer units, and multi-unit dwellings using upper and lower housings, PVC pipe, and elongate rectangular extensions as necessary.

In accordance with another exemplary embodiment of the present invention, an outside or exterior vent box includes rectangular upper and lower housings with cylindrical flanges extending from opposite faces of the assembled item. Additionally, a nozzle, flap, or displaceable louver is placed over the cylindrical flange extending from the upper housing to provide an aesthetically pleasing appearance, and reduce or eliminate the possibility of the inadvertent entrance of animals, bugs, or water into the vent box.

In accordance with yet another exemplary embodiment of the present invention, a rectangular housing having opposing cylindrical flanges is used as an exterior exhaust vent box. For example, the rectangular housing includes a large diameter cylindrical flange on one face and a smaller diameter cylindrical flange on the opposite face for attachment to and venting exhaust gases from a small diameter PVC pipe which serves as a vent tube for exhaust gases from bathroom plumbing.

The principal object of the present invention is the provision of an improved dryer vent box and method.

Another object of the present invention is the provision of an improved exterior dryer vent box.

Yet another object of the present invention is the provision of an improved exterior exhaust vent box.

A still further object of the present invention is the provision of a relatively inexpensive, easily installed, extremely adaptable dryer vent box system and method which finds utility in a variety of applications.

Yet another object of the present invention is the provision of the dryer vent box which is shaped and dimensioned so as to be received within the confines of a conventional 2×4 studded wall.

Other objects and further scope of the applicability of the present invention will become apparent from the detailed description to follow, taken in conjunction with the accompanying drawings wherein like parts are designated by like reference numerals.

DETAILED DESCRIPTION OF THE PREFERRED EMBODIMENTS

Figure 2:
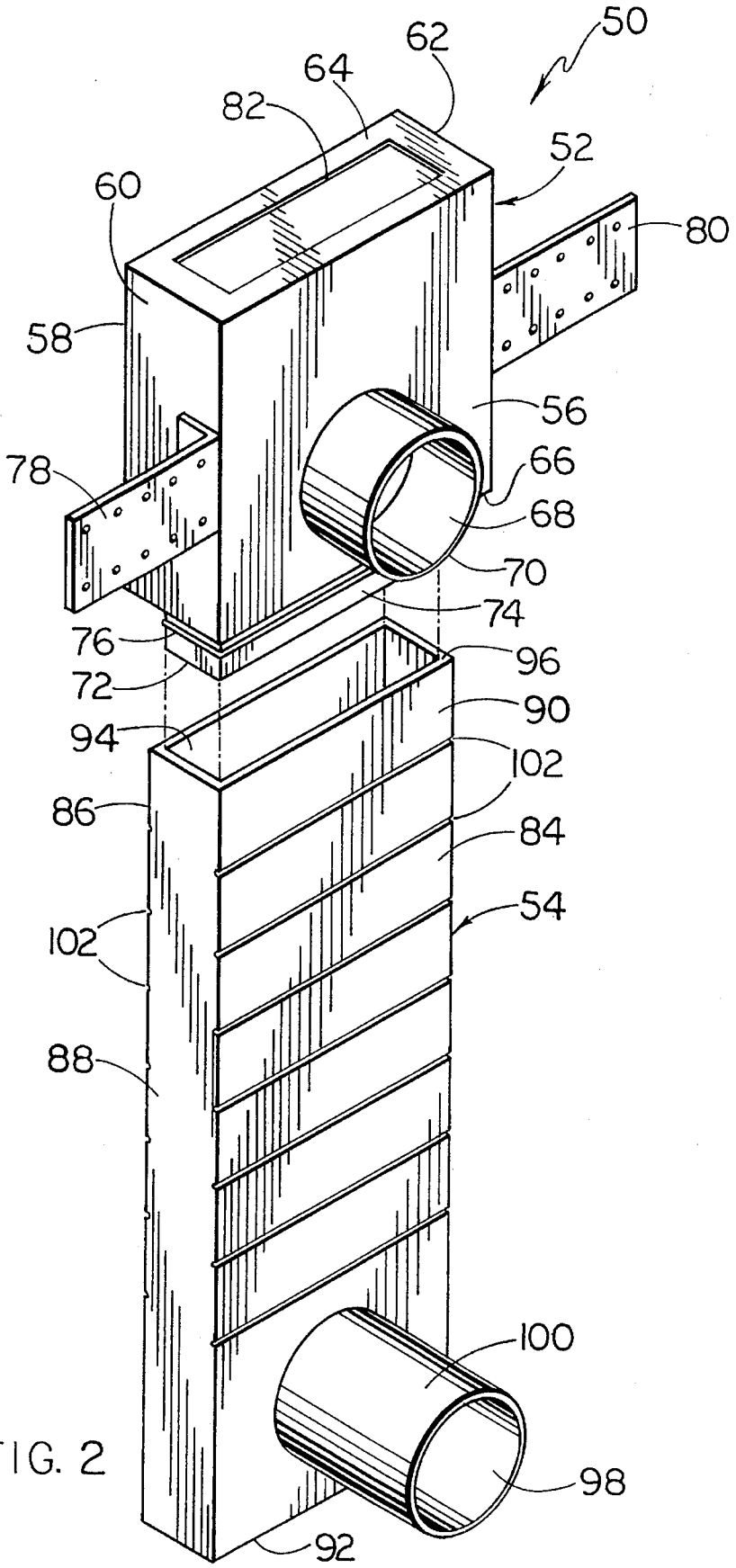
FIG. 2 is an exemplary perspective view representation of a dryer vent box of the present invention.
Figure 3:
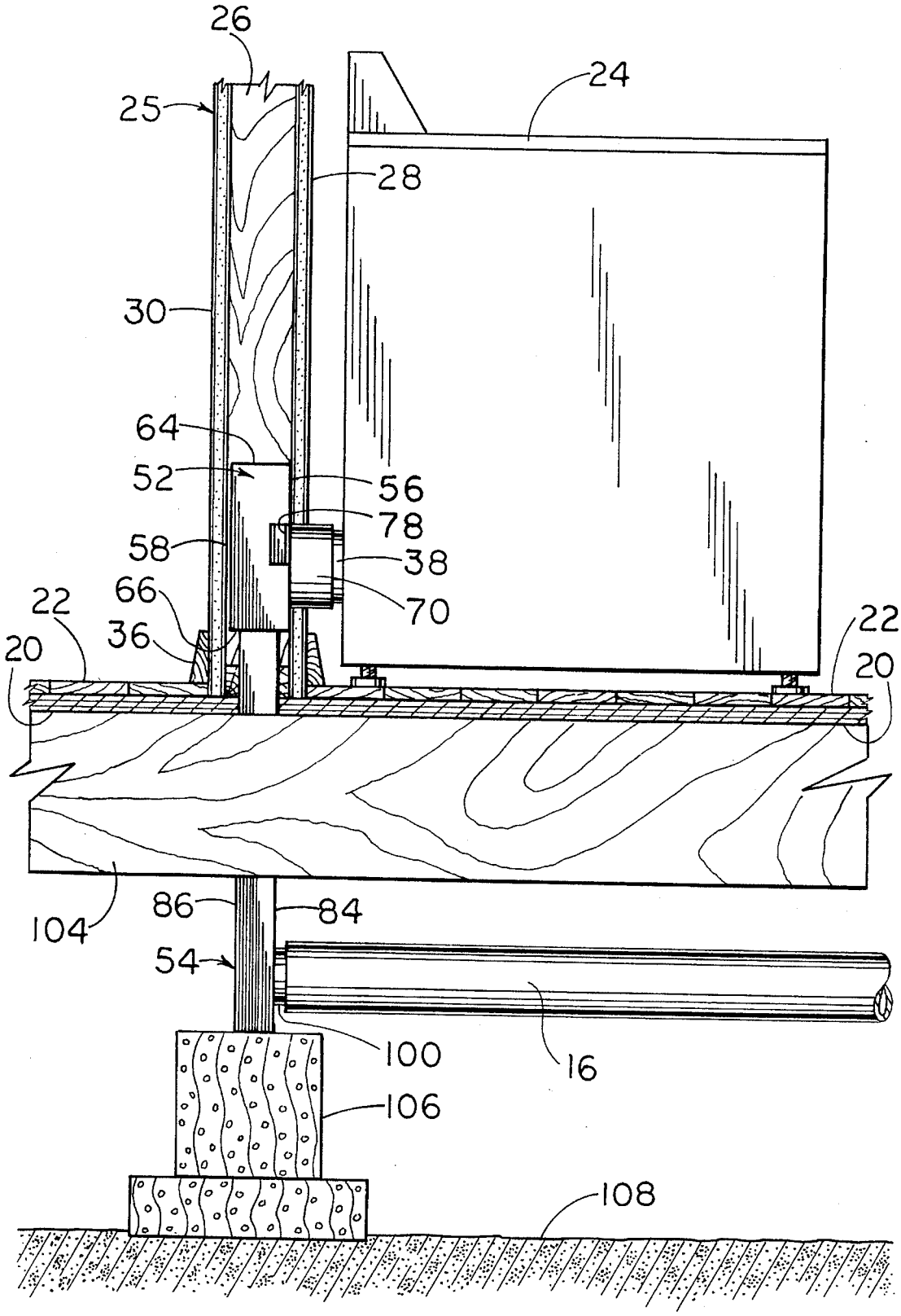
FIG. 3 is a schematic side view partial cross-section illustration of the dryer vent box of FIG. 2 in use in an interior wall of a home with pier and beam construction.

In accordance with an exemplary embodiment of the present invention as shown in FIGS. 2 and 3 of the drawings, a dryer vent box generally designated by the reference numeral 50 includes upper and lower substantially rectangular housings 52 and 54. Upper housing 52 has front, back, right, left, top and bottom planar surfaces 56, 58, 60 62, 64 and 66 defining a substantially rectangular internal cavity or chamber. Upper housing 52 also includes a circular inlet opening 68 defined by the inner surface of a cylindrical flange 70 and a rectangular outlet opening 72 defined by the inner surface of a rectangular flange 74 which extends from bottom wall 66. Rectangular outlet 74 includes a protruding exterior nub or ridge 76 which facilitates a friction fit of the outlet 74 within the rectangular inlet of lower housing 54. Right and left hand mounting brackets, tabs, or wings 78 and 80 are attached to and extend from respective side walls 60 and 62. The front face of each of the brackets 78 and 80 is flush with the front face of front wall 56.

The top wall 64 of upper housing 52 includes a rectangular groove or notch 82 defining a central rectangular portion which can be knocked out or removed by sawing to produce an opening which matches the rectangular inlet of lower housing 54 and is adapted to receive the rectangular outlet 74 of another upper housing 52 or the rectangular outlet of a rectangular extension (FIG. 4) as will be described in greater detail below.

Lower rectangular housing 54 includes front, back, right, and left side and bottom walls 84, 86, 88, 90, and 92 defining a substantially rectangular internal chamber or cavity. Bottom housing 54 also includes an upper rectangular inlet or opening 94 and a rectangular frame-like upper face or surface 96. Lower housing 54 further includes a circular outlet opening 98 defined by the inner surface of a circular flange 100 which extends from the front face of front wall 84. Front and back walls 84 and 86 include a plurality of spaced grooves or saw marks 102 which facilitate the shortening of the lower housing to provide for the proper placement of the upper housing inlet 68 relative to the clothes dryer outlet 38. Typically, this is 5½ inches above the floor so that the dryer outlet 38 is received within the cylindrical flange 70 of upper housing 52 merely by pushing the dryer back towards the wall so that the dryer outlet 38 is telescopically received within the cylindrical flange 70 as shown in FIG. 3 of the drawings. Although the inner surface of flange 70 is shown smooth in FIG. 2, it is contemplated that circumferential nubs or protrusions can be added therein to provide a substantially airtight pressure fit with outlet 38.

With reference again to FIG. 1 of the drawings, the dryer vent box 50 of the present invention replaces not only the PVC elbows 10 and 14 and vertical pipe section or riser 12 of the conventional dryer vent assembly, but also, the flexible conduit 40. Since the upper housing 52 can be located in the proper position to mate with the dryer outlet 38, the flexible conduit 40 can be eliminated.

Although the dryer 24 is shown a couple of inches away from the wall 28, in FIG. 3 of the drawings it is to be understood that the dryer can be pushed back against cylindrical flange 70 and dryer outlet 38 is fully received within the cylindrical flange so that the dryer can be placed within an inch or less of the wall 28. This provides for maximum usage of the remaining room space and eliminates unnecessary waste of space due to dryer 24. Also, by reducing the gap between the dryer and the wall, one reduces the chance that items are mistakenly dropped behind the dryer 24. This gap can be further reduced by cutting off or removing a selected length of the front of cylindrical flange 70 using a pipe cutter or hacksaw to shorten the flange 70 to its minimum length.

If for some reason it is desirable to move the drier a certain distance away from the wall to, for example, be in a position flush with an adjacent clothes washing machine which has behind it, water hoses and an electrical cord, the flange 70 can be left at its full length and/or an adapter can be used between cylindrical flange 70 and dryer outlet 38 with the adapter being a rigid short length of PVC pipe having one end with an outer diameter which corresponds to the outer diameter of the outlet 38 so that it fits within cylindrical flange 70 and the other end having an inner diameter which corresponds to the inner diameter of cylindrical flange 70 so as to fit around dryer outlet 38.

Figure 1:
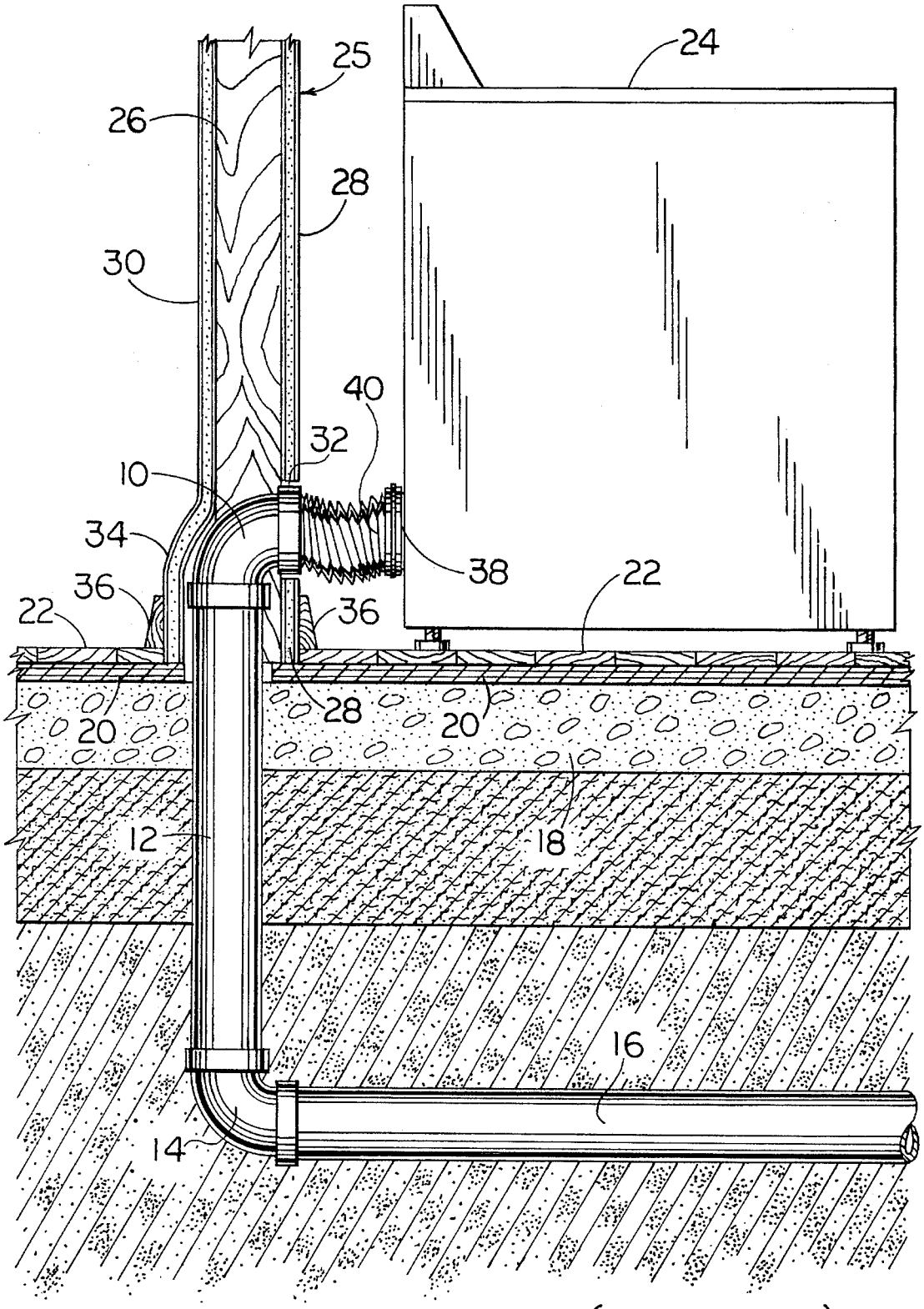
FIG. 1 (PRIOR ART)
FIG. 1 is a schematic side view partial cross-section illustration of a conventional through-the-wall and floor dryer vent assembly made up of cylindrical PVC pipe and elbows.

Since the dryer vent box 50 replaces the PVC elbows 10 and 14, and the pipe length 12 of FIG. 1, and the dryer vent box 50 includes upper housing 52 and lower housing 54 dimensioned to fit within the confines of a standard 2×4 studded wall between the drywall, panelling, or other wall covering that is used, and also between adjacent studs, the wall protrusion 34 of FIG. 1 is eliminated. Typically, walls are studded at 12, 14, 16, 18, or 24 inches, and the dryer vent box 50 is dimensioned accordingly. In accordance with a particular example of the dryer vent box 50, the upper housing 52 has a front to back dimension of about three inches, a side to side dimension of about ten inches, an overall vertical height of about ten inches, a cylindrical flange protruding about three inches and having an inner diameter just greater than four inches. Also in accordance with this particular example, the lower housing 54 has an overall height of about three feet, a front to back dimension of about two inches, a side to side dimension of about nine inches, and has a cylindrical flange with an outer diameter of about 5½ inches, and a length of about six inches. Also, the upper housing 52 has a rectangular outlet with a front to back dimension of about 1½ inches, and a side to side dimension of about 8½ inches, and a vertical length of about two inches.

In the pier and beam construction shown in FIG. 3 of the drawings, the plywood decking 20 is supported on floor joists or beams 104. The lower surface 92 of lower housing 54 is shown supported on concrete blocks 106 which space the lower housing 54 from the ground surface 108. It is to be understood that the lower housing 54 can be rested upon a layer of gravel or on the ground itself depending upon the distance between the flooring 20 and 22 and the ground surface 108. Also, it is contemplated that the lower housing 54 and/or the PVC pipe 16 may be suspended from the floor joists 104 by appropriate brackets or strapping.

The dryer vent box 50 of the present invention has equal utility in home or building construction, wherein the flooring is either a slab or concrete foundation type construction (FIG. 1), or pier and beam with a crawl space (FIG. 3). The dryer vent box 50 of the present invention is adaptable to both residential and commercial construction, prefab housing, mobile homes, and the like.

Figure 4:
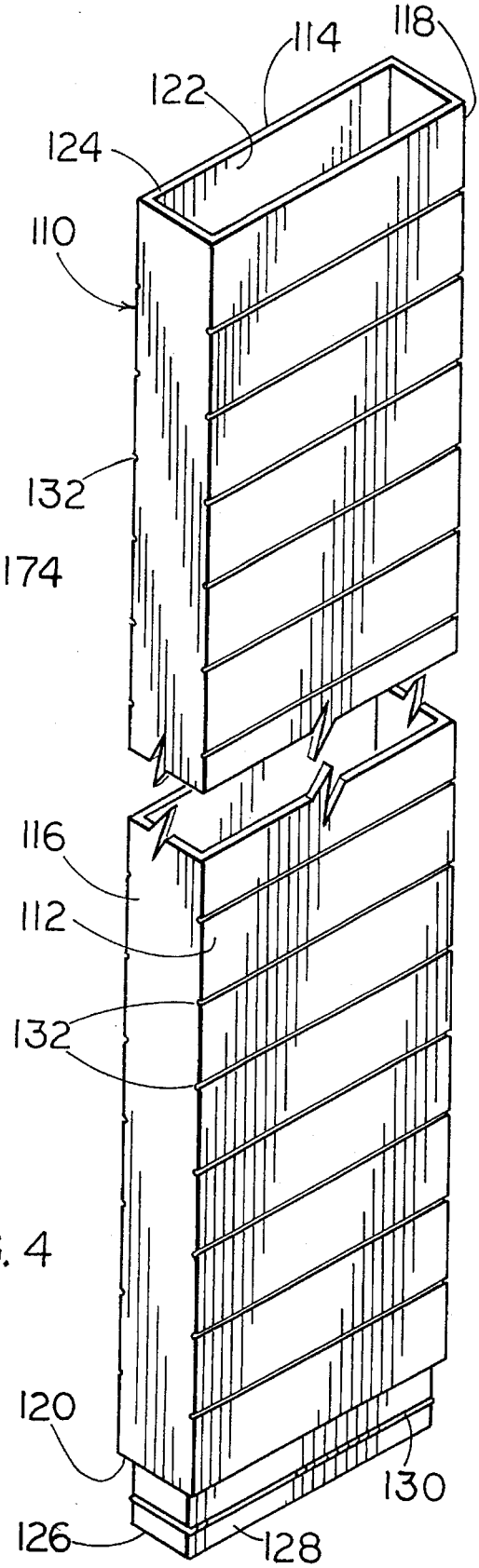
FIG. 4 is a perspective view illustration of an elongate rectangular extension adapted for use with the dryer vent box of FIG. 2.

Moreover, the dryer vent box 50 is utilized in situations where the upper housing 52 is spaced from lower housing 54 using one or more of the rectangular extension 110 shown in FIG. 4 of the drawings. The rectangular extension 110 has front, back, right, left, side, and bottom surfaces 112, 114, 116,118, and 120, an upper rectangular inlet opening 122, and a rectangular frame-like upper surface 124. Extension 110 also has a rectangular outlet opening 126 defined by a rectangular flange 128 extending from bottom surface 120. Flange 128 has a protruding nub or bur 130 around the exterior thereof. Front and back surfaces 112 and 114 include saw marks, notches or grooves 132 which facilitate the sawing off or shortening of the extension as necessary for a particular application. Note that the rectangular inlet 122 has the same dimensions as rectangular inlet 94 of lower housing 54. Also, rectangular outlet flange 128 has the same dimensions as rectangular outlet flange 74 of upper housing 52. Thus, one or more extensions 110 can be inserted between the housings 52 and 54. A variety of combinations of upper housings, lower housings, and extensions can be used to provide for through-the-wall, through- the-floor, and/or through-the-ceiling venting of one or more clothes dryers.

In accordance with a particular example of the present invention, the extension 110 is an overall height of about three feet, a front to back dimension of about two inches, a side to side dimension of about nine inches and is used to raise the upper housing 52 so that the cylindrical flange 70 mates with the dryer outlet of a dryer in a stacked dryer over washer appliance arrangement.

In accordance with another exemplary embodiment of the present invention, the housing 52, housing 54, and extension 110 are used for a through-the-wall-and-ceiling venting by inverting the housings 52 and 54, and extension 110 and running the pipe 16 through the ceiling.

Although it is preferred to use PVC materials in constructing the dryer vent box of the present invention, other resins, plastics, polycarbonates, galvanized metals, stainless steel, and the like may be used given the particular application, and which will meet local, state and federal building codes.

Figure 5:
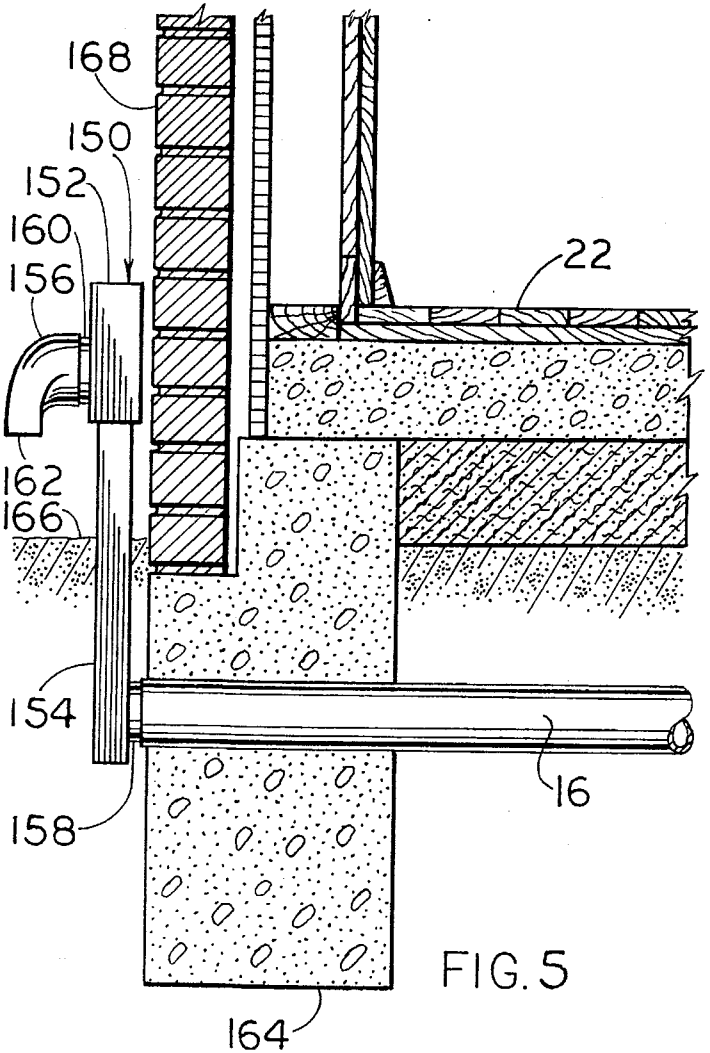
FIG. 5 is a schematic side view partial cross section representation of an exterior dryer vent box in accordance with the present invention.
Figure 7:
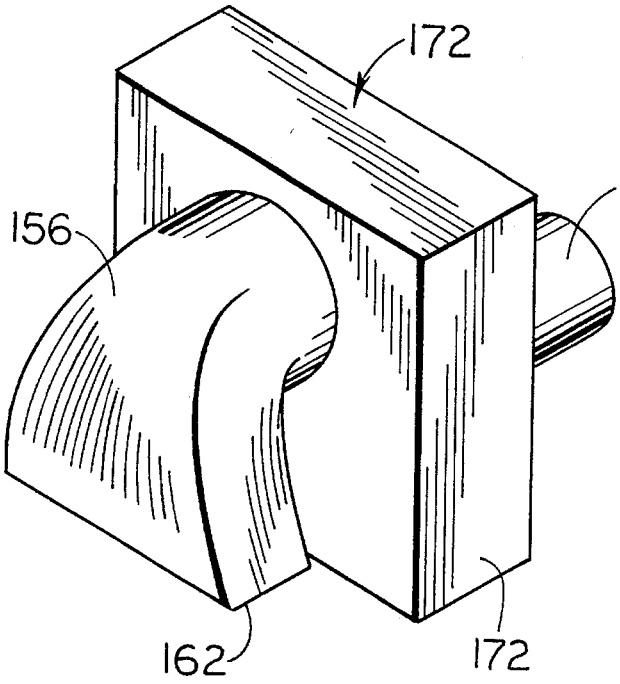
FIG. 7 is a perspective view illustration of the exterior exhaust box of FIG. 6.

With reference to FIG. 5 of the drawings, in accordance with another exemplary embodiment of the present invention, an outside or exterior clothes dryer vent box is generally designated by the reference numeral 150 and shown to include an upper rectangular housing 152, a lower rectangular housing 154, and an outlet hood or down spout 156. The upper and lower housings 152 and 154 are substantially identical to the housings 52 and 54 of dryer vent box 50 (FIGS. 2 and 3) except that the tabs 78 and 80 have been removed. The lower housing 154 includes a cylindrical flange 158 which serves as a fluid gas or air inlet to the vent box 150. Upper housing 152 includes a cylindrical flange 160 which serves as a fluid outlet, and which is adapted to receive the spout 156 which directs the air or exhaust downwardly. Clothes dryer exhaust passes through dryer vent box 50 (FIG. 3), PVC pipe 16, inlet 158, housing 154, housing 152, outlet 160, and out spout 156. The spent 156 has a substantially rectangular outlet opening 162 which directs these gases in a downward direction. Spout 156 is designed to have a rectangular outlet which is substantially the same in total cross-sectional area as the cylindrical opening thereof which fits over flange 160.

The PVC pipe 16 serves to direct air exhaust from a clothes dryer vented through an interior wall down under the foundation of the house out through the foundation or footer 164 in a location beneath the surface of the soil 166. With the housing 152 and 154 formed of PVC or similar materials, it is possible to join the PVC pipe 16 and housing 154 with a PVC solvent or fixative which provides a water-tight seal between the exterior of flange 158 and the interior of pipe 16.

Figure 6:
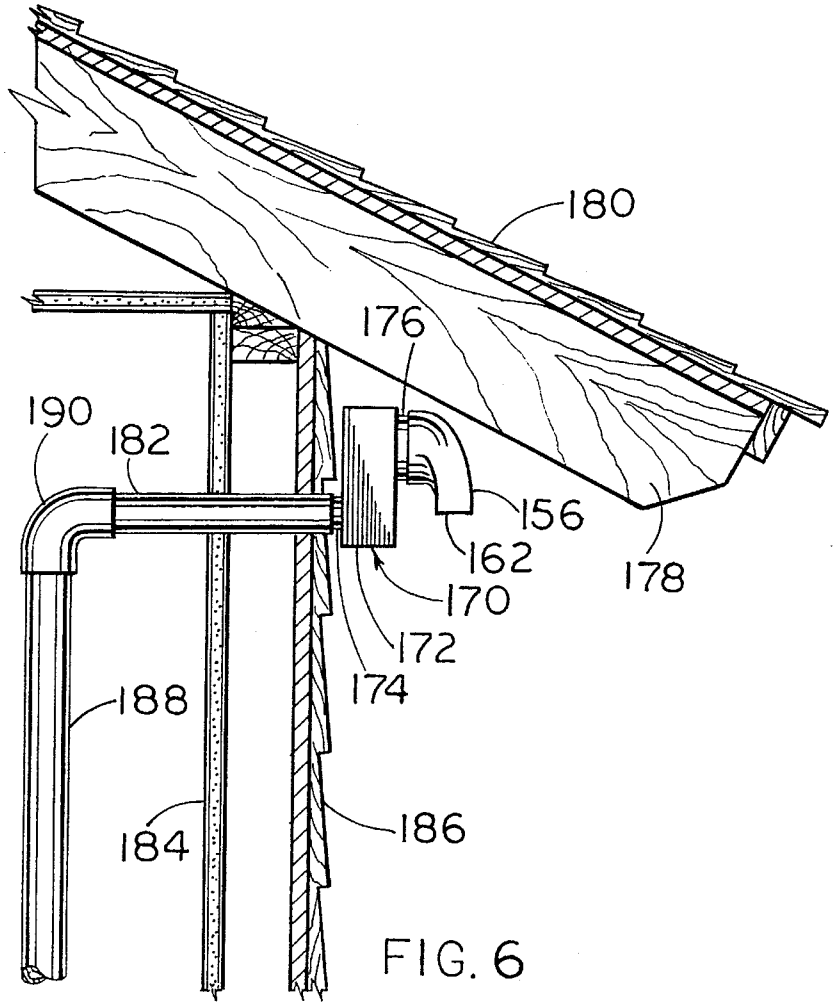
FIG. 6 is a schematic side view partial cross-section representation of an exterior exhaust box in accordance with another embodiment of the present invention.

In accordance with another exemplary embodiment of the present invention, as illustrated in FIG. 6 of the drawings, an exterior exhaust vent box is generally designated by the reference numeral 170, and shown to include a rectangular housing 172, a small diameter circular flange 174, and a large diameter circular flange 176. The small diameter cylindrical flange 174 serves as a gas, fluid, or exhaust inlet to a substantially rectangular cavity or chamber within housing 172. The larger cylindrical flange 176 serves as a gas, fluid, or exhaust outlet of the housing 172. A down-turned hood or spout 156 is attached to outlet flange 176 so as to direct the vented gases downwardly away from the eaves 178 of a roof 180.

The inlet flange 174 is received within the open end of a length of PVC pipe 182 which passes through exterior wall 184 and siding 186. Pipe 182 is connected to a vertical exhaust pipe 188 via an elbow 190. Exhaust pipe 188 serves to exhaust gases, vapors, and fumes from plumbing, sewer, and the like. Typically, such gases are either vented through an open ended section of pipe directly into the attic of a house or building, through the roof with a six or eight inch section of pipe extending upwardly from the shingles of the roof, or vented out of the side of a building near the roof. This typical venting of the exhaust gases is unsightly and may allow debris or insects to enter into the exhaust pipe 188. In accordance with the present invention, the exhaust box 170 is employed to provide an outside venting of these exhaust gases, an aesthetically pleasing arrangement, and the utilization of an attachment which prevents debris, insects, rain, and the like from entering the exhaust pipe.

It is preferred that the vent box 170, down spout 156, and pipe section 182 be formed of compatible PVC or other sturdy molded plastic material which allow then to be joined together with conventional PVC or pipe fitting solvents and form a water-tight, permanent assembly.

Thus, it will be appreciated that as a result of the present invention, a highly effective improved dryer vent box and method, dryer venting system and method, outside vent box and method, and exhaust vent box and method are provided by which the principle objective, among others, is completely fulfilled. It is contemplated and will be apparent to those skilled in the art from the preceding description and accompanying drawings, that modifications and/or changes may be made in the illustrated embodiments without departure from the present invention. Accordingly, it is expressly intended that the foregoing description and accompanying drawings are illustrative of preferred embodiments only, not limiting, and that the true spirit and scope of the present invention be determined by reference to the appended claims.

What is claimed is:

1. A clothes dryer vent box comprising:

a first rectangular housing adapted to be received within a wall and having a cylindrical flange adapted to extend through an opening in a wall and receive a cylindrical dryer outlet, and a rectangular flange oriented perpendicular said cylindrical flange, a second rectangular housing adapted to be at least partially received within a wall and having a rectangular opening adapted to receive said rectangular flange of said first housing, and a cylindrical flange oriented perpendicular to said rectangular opening and adapted to connect with a cylindrical pipe.

2. The clothes dryer vent box as recited in claim 1 further comprising a third rectangular housing adapted to be received within a wall and placed between said first and second housing and having a rectangular opening at one end adapted to receive said rectangular flange of said first housing, and a rectangular flange at the other end adapted to be received in the rectangular opening of said second housing.

3. The clothes dryer vent box as recited in claim 1 wherein said vent box is an interior wall vent box.

4. A clothes dryer venting system comprising a clothes dryer vent box including a first rectangular housing adapted to be received within a wall and having a cylindrical flange adapted to extend through an opening in a wall and receive a cylindrical dryer outlet, and a rectangular flange oriented perpendicular to said cylindrical flange, a second rectangular housing adapted to be at least partially received within a wall and having a rectangular opening adapted to receive said rectangular flange of said first housing, and a cylindrical flange oriented perpendicular to said rectangular opening and adapted to connect with a cylindrical pipe, and a cylindrical pipe adapted to be connected to said cylindrical flange.

5. A clothes dryer venting system comprising a clothes dryer vent box including a first rectangular housing adapted to be received within a wall and having a cylindrical flange adapted to extend through an opening in a wall and receive a cylindrical dryer outlet, and a rectangular flange oriented perpendicular to said cylindrical flange, a second rectangular housing adapted to be at least partially received within a wall and having a rectangular opening adapted to receive said rectangular flange of said first housing, and a cylindrical flange oriented perpendicular to said rectangular opening and adapted to connect with a cylindrical pipe, a third rectangular housing adapted to received within a wall and placed between said first and second housings and having a rectangular opening at one end adapted to receive said rectangular flange of said first housing, and a rectangular flange at the other end adapted to be received in said rectangular opening of said second housing, and a cylindrical pipe adapted to be connected to said cylindrical flange.

6. The clothes dryer venting system as recited in claim 5 wherein each of said housings and said pipe are molded of polyvinyl chloride materials.

7. The clothes dryer venting system as recited in claim 5 comprising a plurality of at least one of said first, second and third housings.

8. An in-wall vent box for use with a clothes dryer comprising a first rectangular housing adapted to be received within a wall and having front, back, right, and left sides and a top and bottom defining a rectangular internal chamber and having an overall front to back dimension of less than four inches and a side to side dimension of less than 16 inches, a circular inlet opening defined by the inner surface of a cylindrical flange extending from said front side and adapted to extend through an opening in a wall, and a rectangular outlet opening defined by an inset rectangular flange extending from said bottom.

9. The vent box as recited in claim 8 wherein said cylindrical flange is adapted to receive a clothes dryer outlet.

10. The vent box as recited in claim 8 further comprising respective mounting tabs extending from each of said right and left sides of said first housing.

11. The vent box as recited in claim 12 further comprising a second rectangular housing adapted to be at least partially received within a wall and having front, back, right, and left sides and a bottom defining a rectangular internal chamber, and having overall a front to back dimension of less than four inches and a side to side dimension of less than 16 inches, a rectangular inlet opening defined by the upper inner surfaces of said front, back, right and left sides and adapted to receive said rectangular flange of said first housing, and a circular outlet opening defined by the inner surface of a cylindrical flange extending from said front side of said second housing.

12. The vent box as recited in claim 8 further comprising a rectangular extension adapted to be received within a wall and having front, back, right, and left sides and a bottom defining a rectangular internal chamber and having overall a front to back dimension of less than four inches and a side to side dimension of less than 16 inches, a rectangular inlet opening defined by the upper inner surfaces of said front, back, right and left sides and adapted to receive said rectangular flange of said first housing or a rectangular flange of another extension, and a rectangular outlet opening defined by a rectangular flange extending from said bottom of said extension and adapted to be received within said rectangular inlet opening of said second housing or the rectangular inlet opening of another extension.

13. In a method of venting clothes dryer exhaust gases, the improvement comprising using at least said first and second housings of claim 11, in place of conventional pipe and elbows in a wall.

14. The method as recited in claim 13 further including the step of placing at least one of said extensions of claim 12 between said first and second housings.

15. The clothes dryer vent box as recited in claim 1 wherein said first housing includes respective mounting tabs extending from the sides thereof.

16. The clothes dryer vent box as recited in claim 1 wherein said rectangular flange of said first housing is an inset flange.

17. The clothes dryer vent box as recited in claim 1 wherein said second housing includes a plurality of saw marks to facilitate the shortening of the second housing.

18. The clothes dryer venting system as recited in claim 5 wherein said first housing has a rectangular knockout in the upper surface thereof adapted to be removed in order to receive the rectangular flange of another housing.

* * * * *